United States Patent [19]

Lai

[11] Patent Number: 5,019,691

[45] Date of Patent: May 28, 1991

[54] HEATING DEVICE

[76] Inventor: Fute Lai, No. 35, Shih-Chien Street, Tainan, Taiwan

[21] Appl. No.: 551,075

[22] Filed: Jul. 11, 1990

[51] Int. Cl.[5] ..... H05B 3/26

[52] U.S. Cl. ..... 219/432; 219/518; 219/543

[58] Field of Search ..... 219/432, 433, 435, 518, 219/448, 543, 436, 438

[56] References Cited

U.S. PATENT DOCUMENTS

| | | | |
|---|---|---|---|
| 2,609,478 | 9/1952 | Crawford | 219/435 |
| 2,611,069 | 9/1952 | Frazier | 219/518 |
| 3,092,704 | 6/1963 | De Woody | 219/432 |
| 3,488,473 | 1/1970 | Sanders | 219/432 |
| 4,493,978 | 1/1985 | Starnes | 219/438 |

*Primary Examiner*—Teresa J. Walberg

*Attorney, Agent, or Firm*—Morton J. Rosenberg; David I. Klein

[57] ABSTRACT

An arrangement of components for constructing a heating device employing super thin conductive film (STCF) heating element includes the STCF heating element, in a layer, attached externally to a pan bottom by means of calcination through an aluminum monoxide film and a base device having terminal units for applying a suitable voltage to the STCF heating element when supporting the pan thereon.

1 Claim, 4 Drawing Sheets

HEATING DEVICE

BACKGROUND OF THE INVENTION

The present invention relates to a heating device, and more particularly to a structure for a heating device utilizing a super thin conducting film (STCF).

Numerous types of heating devices having been developed in the prior art. Said conventional heating devices transmit heat generated therefrom by means of contact or radiation which usually causes a high percentage of heat loss in transmission. To this end, the inventor has attempted to make an improved heating device to overcome drawbacks of existing heating devices.

SUMMARY OF THE INVENTION

One of the objectives of this invention is to provide a heating device which can diminish the disadvantages of existing heating devices.

It is another objective of this invention to provide a heating device having a heating element attached to an object, such as a pan, to be heated for enhancing heat transfer efficiency.

It is yet another objective this invention to provide a heating device with its components or parts needing no welding in electrical connections.

With the above objectives in view, an arrangement of components for constructing a heating device employing super thin conducting film (STCF) heating element comprises the heating element, in a layer, attached externally to a pan bottom by means of calcination through an aluminum monoxide film and a base device having terminal units for applying a suitable voltage to the STCF heating element when the pan is placed on the base.

DETAILED DESCRIPTION OF THE PREFERRED EMBODIMENT

A heating device employing a super thin conducting film (STCF) of this invention comprises an object to be heated, which is preferably to be pan 3 (FIG. 5) made of electrically insulated and high thermal conductivity material such as glass, ceramic or porcelain of berylia, having a flat or smooth bottom 31, a STCF heating element 1 attached to the bottom 31 of pan 3 and a base device 2 (FIG. 3) for supporting pan 3.

Figure 1:
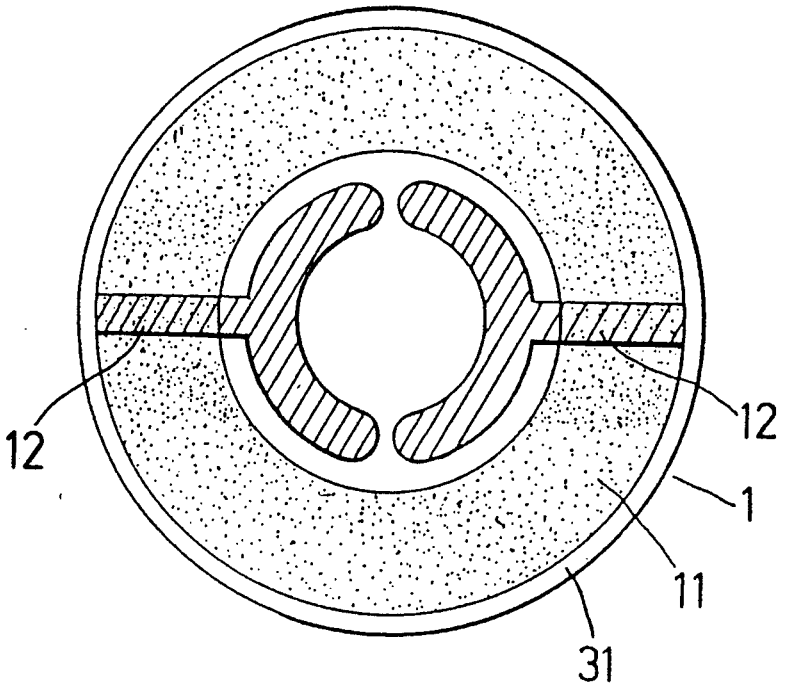
FIG. 1 is a plan view of a STCF heating element attached to the bottom of a pan imparting the heating device of this invention.

As shown in FIG. 1, the STCF heating element 1 to be employed in this heating device is formed by a circular shaped STCF layer 11 which is provided in opposition with a pair of curved metal film electrodes 12 an inner portions of the pan bottom 31 and the edge of one electrode is set apart from the edge of the opposite electrode. Said bottom 31 of pan 3 is firstly coated with a film of aluminum monoxide, an electrically insulating material, then the STCF heating layer 1 is attached to the pan bottom 31 through the aluminum monoxide film by means of calcination. As the STCF heating element 1 is attached to the pan bottom 31, said pan bottom 31 becomes a heat emission plate.

Figure 2:
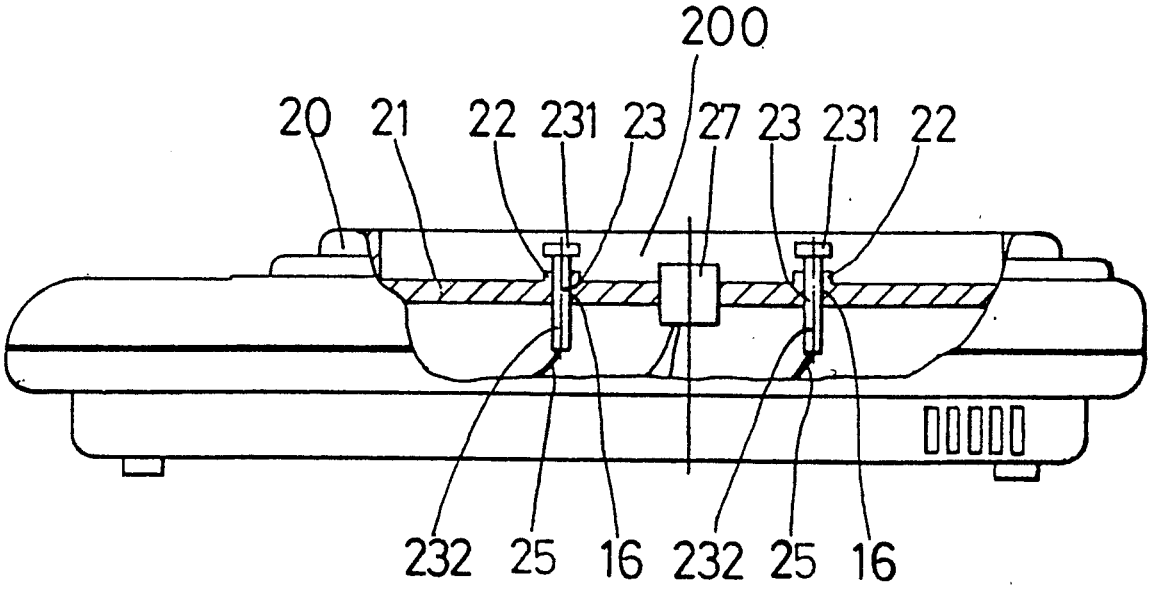
FIG. 2 is a side elevational view of a base device which is partially cross-sectioned, to be employed in the heating device of this invention.
Figure 3:
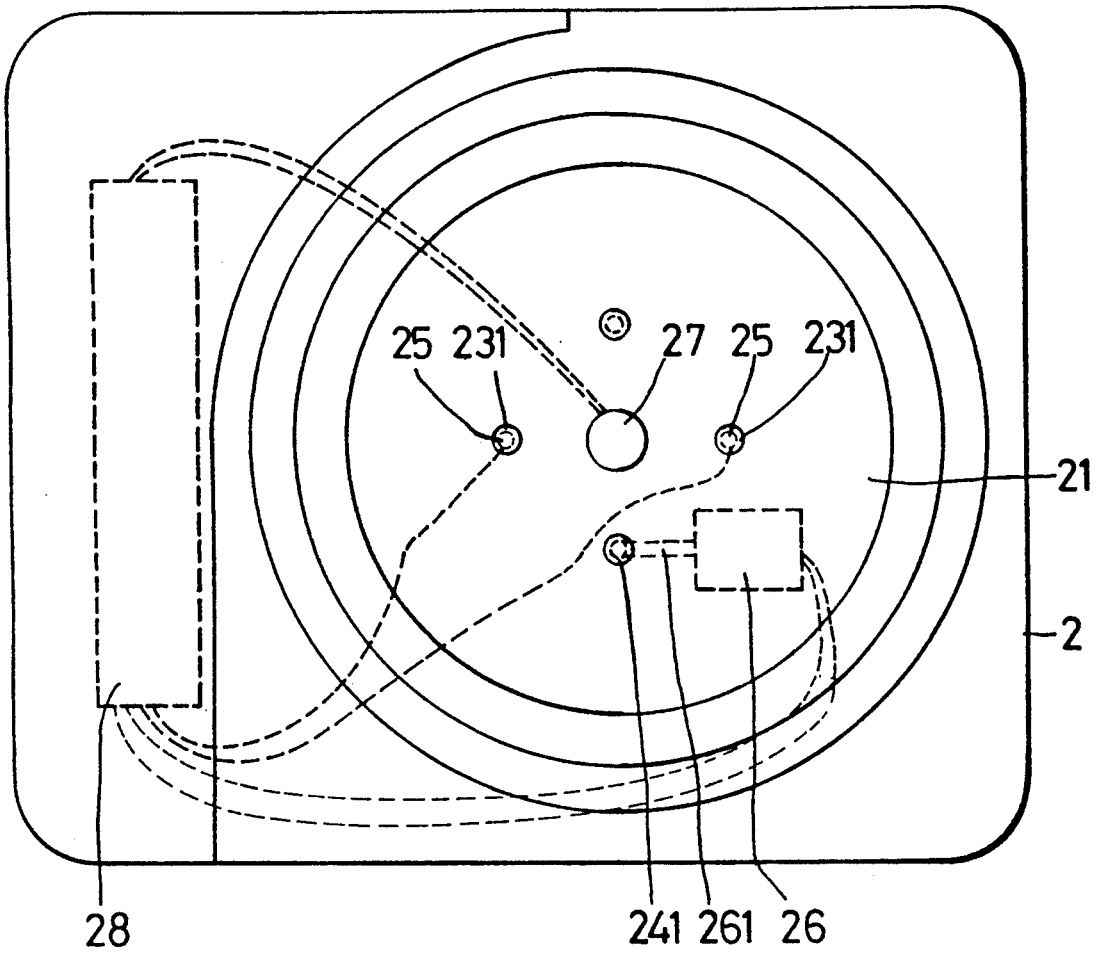
FIG. 3 is a top plan view of the base device shown in FIG. 2.

Referring to FIGS. 2 and 3, the base device 2 has a support frame 20 provided on top thereof. Said support frame 20 is formed with a central recess 200. The bottom 21 of the recess 200 is integrally formed with four bushings 22 having respective projecting portions and evenly distributed around a thermostat 27 which is mounted on the center portion of the bottom 21 for automatically regulating the temperature of pan 3. Each of the bushings 22 is further provided with an aperture 16 extending vertically therethrough for receiving a pin unit 23 or 24 which comprises a pin portion 232 or 242 slidably fitted in the aperture and a disc 231 or 241 integrally formed at top of and in perpendicular relation to the pin portion 232 or 242. The four pin units includes two opposite terminals pins 23 and one operating pin 24. Lower ends of the two opposite terminal pins 23 are electrically connected to a control circuit panel 28 wherein one is connected to the positive electrode and the other is connected to the negative electrode. When the pan 3 is placed on the base device 2, the electrodes 12 of the heating element 1 will be placed on the corresponding top discs 231 of the terminal pins 23. The four pin units 23, 24 slide synchronously and downward from their first position, as shown in FIG. 2, into their second position, where the bottom 31 of the pan 3 contacts the thermostat, as shown in FIG. 5, when evenly supporting the pan 3.

Figure 4:
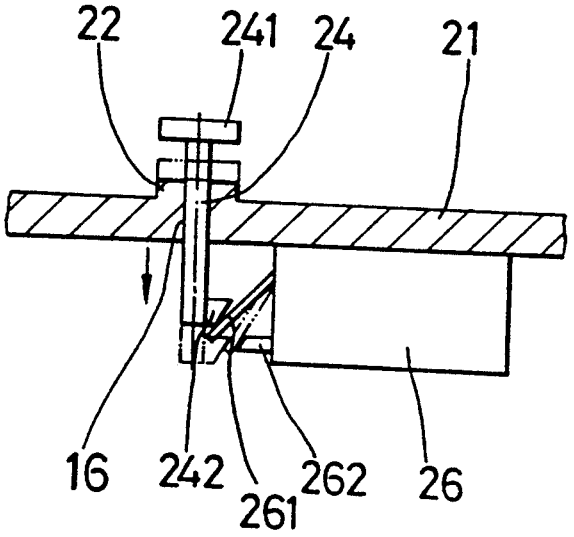
FIG. 4 is an ON-OFF switch actuated by pressing an operating pin and to be employed in the heating device of this invention.

As shown in FIG. 4, a control switch 26 which is in a normally-open state while the operating pin 24 is normally at its first position. When the top disc 241 of the operating pin 24 supports the pan 3 (not shown in FIG. 4) and thus pressing down the operating pin 24 from its first position into its second position (as shown in dotted line), the lower end of the operating pin 24 pushes a lever arm 261 and an actuating arm 262 of the control switch 26 to convert the control switch from its normally-open state into its normally-close state through a projecting portion 242 formed at its lower end.

Figure 5:
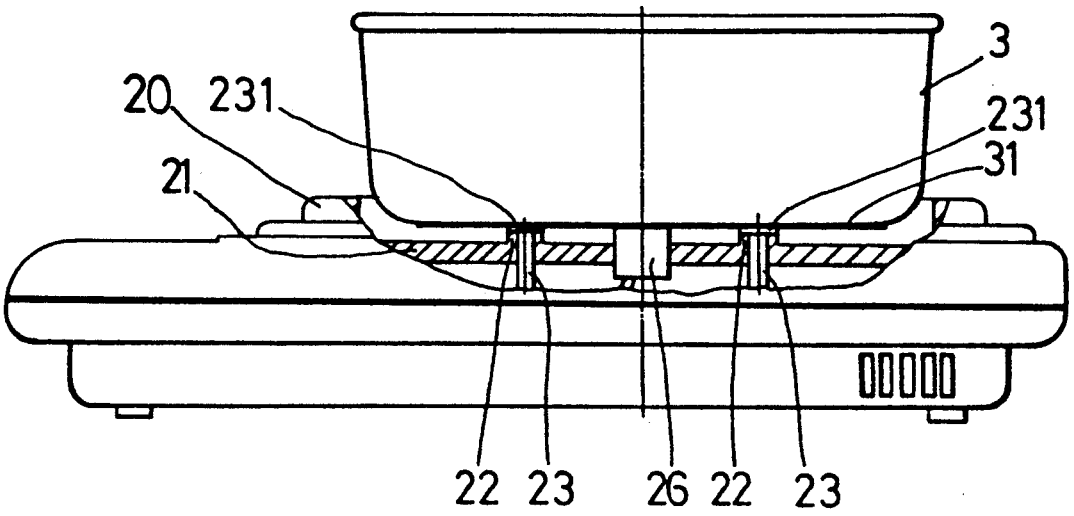
FIG. 5 is a similar view of FIG. 2 with the pan resting on the base device.

In operation, as shown in FIG. 5, the pan 3 is placed on the support frame 20 of the base device 2, a suitable voltage is applied between the pin portions 232 of the opposite terminal units 23, the current flow between the opposite electrodes 12 of the heating element 1 through the STCF layer predominantly on the pan bottom 31, thus generating heat from the pan bottom 31.

Figure 6:
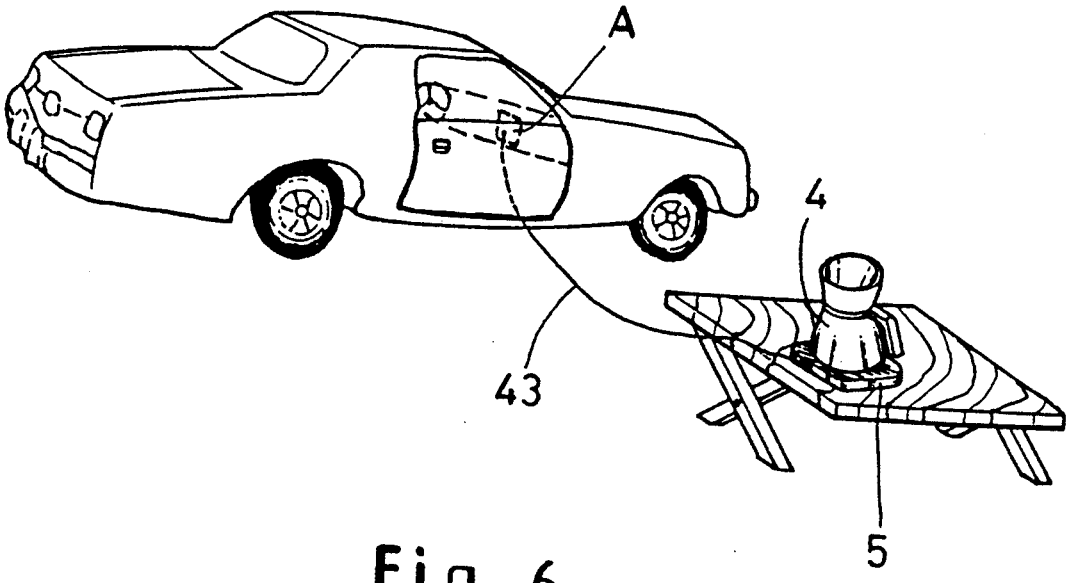
FIG. 6 is a diagramatic view illustrating a percolator employing the heating device of this invention which is electrically connected to a power source of a car.

As shown in FIG. 6, the STCF heating device can be used as a heater of, for example, a percolator 4 for outdoor usage. Said heating device can be electrically connected to an electric power source A of a car through a cable 43.

Figure 7:
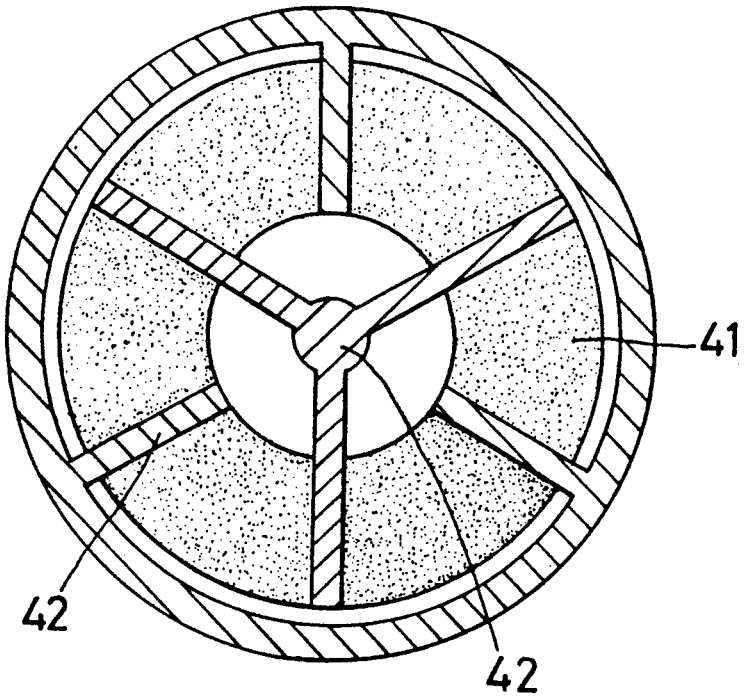
FIG. 7 is a similar view of FIG. 1 with the configuration of the heating element being alternatively arranged.

As shown in FIG. 7, the heating element 1 shown in FIG. 1 can be arranged in an alternative configuration.

Figure 8:
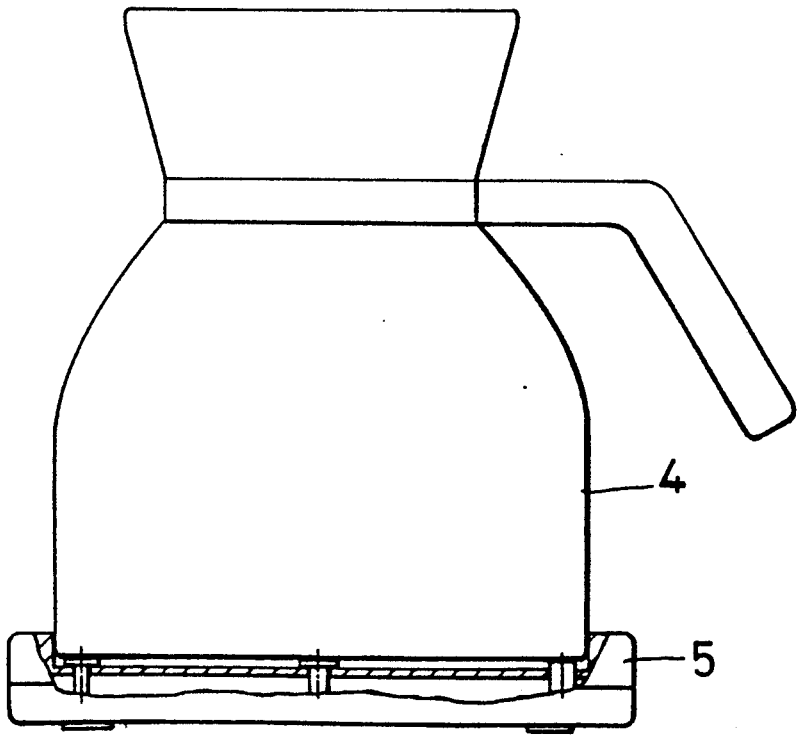
FIG. 8 is a diagramatic side elevation of a pot placed on the heating device of this invention.

The STCF heating element 41 of the alternative embodiment is also formed by a circular shaped STCF layer 41 which is provided in opposition with a plurality pairs of metal film electrodes 42 on the inner portion of the pan bottom 31. Said STCF layer 41 can be attached to a pot 4 by means of calcination. As shown in FIG. 8, the pot 4 so constructed can be placed on a base device 5 for heating.

While the invention has been described with what is presently considered to be the most practical and preferred embodiment, it is to be understood that the invention is not to be limited to the disclosed embodiment, but on the contrary, is intended to cover various modifications and equivalent arrangements.

What is claimed is:

1. A heating device comprising:

a pan made of electrically insulating and high heat conductive material and having a flat bottom being coated with a film of aluminum monoxide on an external surface;

a layer of circular super thin conductive film (STCF) attached to the external surface of the pan bottom through the aluminum monoxide film by means of calcination;

a first electrode being provided on said STCF layer along an inner portion of the external surface of the pan bottom;

a second electrode being provided on said STCF layer along an inner portion of the external surface of the pan bottom opposite to the first electrode with ends thereof being set apart from ends of the first electrode;

a support device having a top plate formed with a plurality of bores extending vertically therethrough;

a control circuit electrically connected to an electricity power source;

a first terminal pin for applying a predetermined voltage to said first electrode having a pin slidably fitted in one of the bores of the top plate with its bottom end electrically connected to the control circuit and its top end formed with a first disc plate for contacting the first electrode means, said first disc plate being adapted to be positioned between a first position of relatively high and a second position of relatively low;

a second terminal pin for applying a predetermined voltage to said second electrode having a pin slidably fitted in another one of the bores of the top plate with its bottom end electrically connected to the control circuit and its top end formed with a second disc plate for contacting the second electrode;

an operating pin for turning on and off of a switch of the control circuit having a pin slidably fitted in another one of the bores of the top plate with its top end formed with a disc plate for contacting with the first and second disc plates for evenly supporting the pan from a first position to a second position to turn on the switch of the control circuit.

* * * * *